US005346207A

United States Patent [19]

Heinen

[11] Patent Number: 5,346,207

[45] Date of Patent: Sep. 13, 1994

[54] ILLUMINATED BACKBOARD

[76] Inventor: Calvin Heinen, 23822 Charlesburg Rd., Kiel, Wis. 53042

[21] Appl. No.: 89,321

[22] Filed: Jul. 12, 1993

[51] Int. Cl.[5] ..... A63B 63/08
[52] U.S. Cl. ..... 273/1.5 R
[58] Field of Search ..... 273/1.5 R, 1.5 A

[56] References Cited

U.S. PATENT DOCUMENTS

| | | | |
|---|---|---|---|
| 3,964,743 | 6/1976 | Salsich | 273/1.5 R |
| 4,916,580 | 4/1990 | Sano et al. | 362/29 |
| 4,984,787 | 1/1991 | Nesbit et al. | 273/1.5 R |
| 4,991,837 | 2/1991 | Deal | 273/1.5 R |
| 5,020,252 | 6/1991 | De Boef | 40/564 |
| 5,114,141 | 5/1992 | Mahoney | 273/1.5 R |

*Primary Examiner*—William H. Grieb
*Attorney, Agent, or Firm*—Donald Cayen

[57] ABSTRACT

An illuminated backboard enables basketball games to be played in the dark. The illuminated backboard comprises a frame and a translucent front panel, both of which have the general outline of a conventional basketball backboard. A lamp inside the frame and proximate the basketball hoop illuminates the front panel. Planar ribs of translucent material extend between the front panel and the back wall of the frame. The front panel glows with less intensity in the areas in front of the ribs. The ribs can be located to radiate from the region of the hoop, so when the lamp illuminates the front panel the ribs appear as darker rays emanating from the hoop. The illuminated backboard may be an independent and separate backboard having its own mounting to a pole or roof, or it may be made to fasten to a conventional backboard. In the latter case, the hoop is joined to the conventional backboard to eliminate all stresses on the illuminated backboard.

20 Claims, 2 Drawing Sheets

ILLUMINATED BACKBOARD

BACKGROUND OF THE INVENTION

1. Field of the Invention

This invention pertains to sports equipment, and more particularly to basketball backboards.

2. Description of the Prior Art.

The game of basketball is universally known and played. Persons of all ages and abilities enjoy the challenge of shooting basketballs through an elevated hoop.

Basketball games are invariably played in a lighted environment. That is necessarily the case, because a person must be able to see the hoop in order to hit it with a ball. Consequently, a lighted court, whether indoors or outdoors, is required for games played after dark. Because of the widespread availability of lighted courts, the same hoops and backboards can be used whether the courts are indoors or outdoors and whether the hoops and backboards are used during the day or after dark. As a result, players and spectators usually pay no attention to the hoops and backboards other than to recognize their existence.

However, a few efforts have been made recently to focus attention on basketball hoops and backboards. For example, U.S. Pat. No. 4,984,787 describes an illuminated basketball rim and backboard. Illumination of the rim and backboard may be continuous, or it may be actuated by a switch that operates only in response to a ball striking a selected portion of the backboard.

The U.S. Pat. No. 4,984,787 discloses a particular construction of an illuminated backboard and hoop, but other designs and further developments are possible.

SUMMARY OF THE INVENTION

In accordance with the present invention, a sturdy and economical illuminated backboard is provided that adds considerable visual appeal to the sport of basketball. This is accomplished by apparatus that includes an electric lamp located in a cavity of a backboard.

The backboard is comprised of a frame and a front panel. The frame has a back wall and a peripheral wall that upstands from the back wall. The frame peripheral wall has an outline that is the same as the outline of a conventional basketball backboard. The front panel is translucent, and it has the same outline as the frame peripheral wall. The front panel is attached to the frame peripheral wall. The frame and the front panel thus cooperate to form the backboard cavity.

The frame is designed to support a conventional basketball hoop. For that purpose, the frame is designed with a mounting surface located at the middle of a bottom portion of the peripheral wall. The hoop may be joined directly to the frame mounting surface. In that construction, the front panel is cut out to clear the hoop. Alternately, the front panel may cover the entire area of the frame. With that design, the front panel is sandwiched between the hoop and the frame mounting surface.

Inside the backboard cavity are secured one or more electric lamps. Preferably, the lamp is located proximate the mounting surface for the hoop. A door is provided in the frame back wall for access to the electric lamp.

Extending between the frame back wall and the front panel are a number of flat elongated ribs. The ribs may be of any length, but they preferably have the same thickness. The ribs are preferably made from the same translucent material as the front panel. They are arranged in angularly spaced planes that intersect in the general region of the electric lamp.

The frame is mounted in known manner to a pole or roof by conventional brackets. The illuminated backboard thus functions as a replacement for a conventional backboard.

When the electric lamp is energized, the illuminated backboard glows across its entire front panel. The glow is most intense in the region near the hoop. The areas of the front panel in front of the ribs glow with less intensity than the adjacent areas. The result is the appearance of darker rays emanating from the hoop.

In a modified embodiment of the present invention, the illuminated backboard is constructed to mount onto a conventional backboard. In that construction, the hoop is removed from the conventional backboard, and the frame of the illuminated backboard is attached to the front face of the conventional backboard. A U-shaped bracket has one leg secured to the back face of the conventional backboard. The bracket extends under the conventional backboard and the illuminated backboard and has a second leg that extends upwardly in front of the illuminated backboard. The hoop is joined to the bracket second leg. In that manner, no stress from the hoop is borne by the illuminated backboard. Removal of the front panel from the frame provides access to the electric lamp.

Other advantages, benefits, and features of the invention will become apparent to those skilled in the art upon reading the detailed disclosure of the invention.

DETAILED DESCRIPTION OF THE PREFERRED EMBODIMENT

Figure 1:
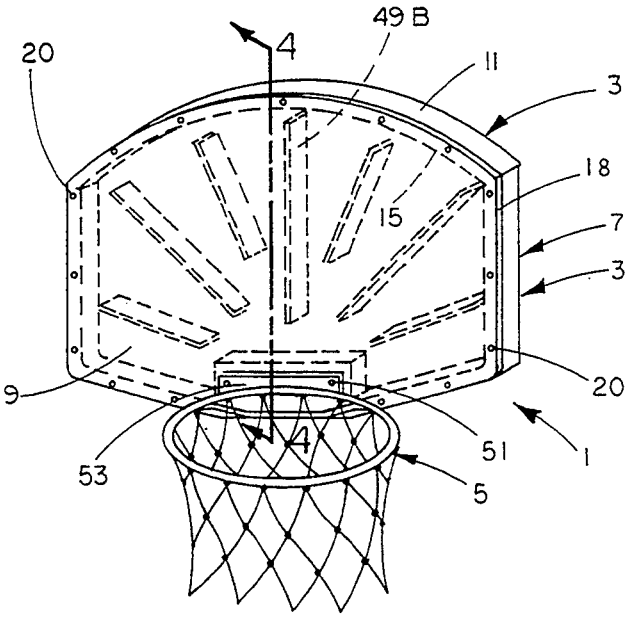
FIG. 1 is a perspective view of the illuminated backboard of the present invention.
Figure 2:
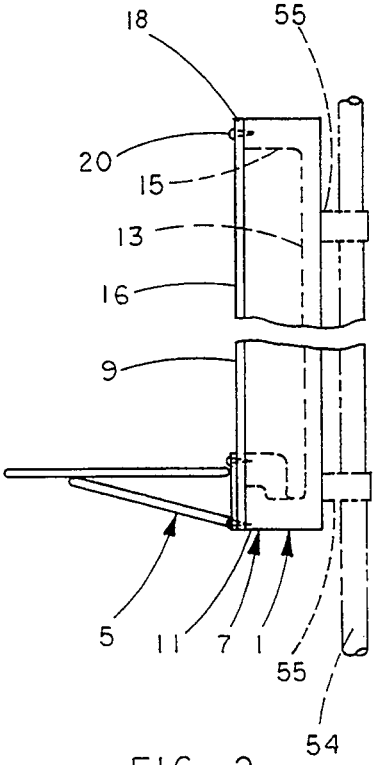
FIG. 2 is a side view on an enlarged scale of FIG. 1.
Figure 3:
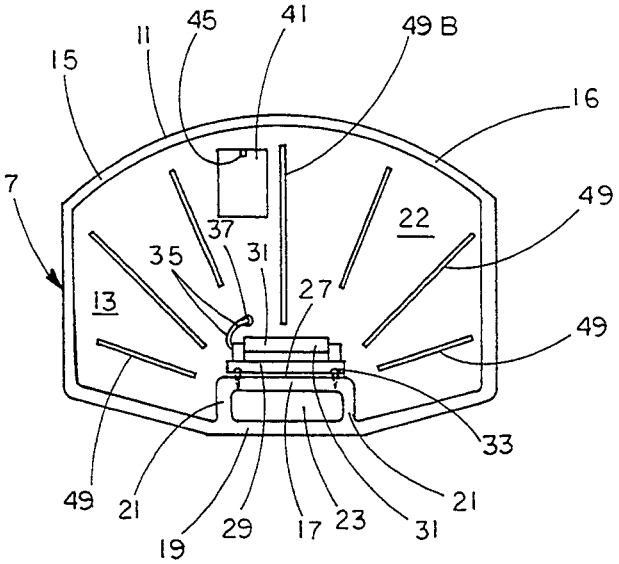
FIG. 3 is a front view of the illuminated backboard with the front panel removed.
Figure 4:
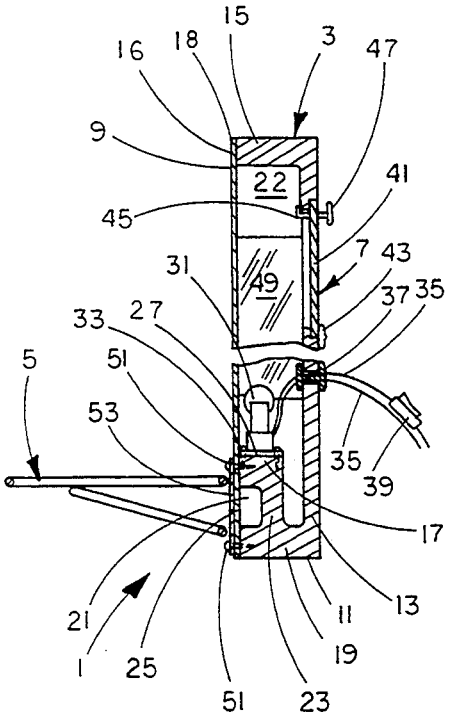
FIG. 4 ms a cross sectional view on an enlarged scale taken along line 4—4 of FIG. 1.

Although the disclosure hereof is detailed and exact to enable those skilled in the art to practice the invention, the physical embodiments herein disclosed merely exemplify the invention, which may be embodied in other specific structure. The scope of the invention is defined in the claims appended hereto.

Referring to FIGS. 1-4, an illuminated backboard 1 is illustrated that includes the present invention. The illuminated backboard is particularly useful for enabling the game of basketball to be played outdoors after dark or indoors in a darkened gymnasium.

The illuminated backboard 1 is comprised of a backboard 3 and a hoop 5. The backboard 1 includes a frame 7 and a front panel 9. The frame 7 may be made from any suitable material, such as wood, plastic, or metal. For purposes of illustration, the frame will be described as though it is made from an opaque plastic material.

The frame 7 has a back wall 13 and a peripheral 15. The outline of the peripheral wall 15 around its exterior edge 11 is substantially similar to the outline of a conventional basketball backboard. A thickness of approximately 0.75 inches for the back wall 13 and approximately 1.5 inches for the peripheral wall 15 are satisfactory. A thickness of approximately 0.31 inches for the front panel 9 gives good results. The front panel has a peripheral edge 18 that conforms with the edge 11 of the frame peripheral wall 15. The front panel is fastened to the front surface 16 of the frame by a number of screws 20 or other suitable fasteners that enter into the frame peripheral wall. The frame and front panel thus cooperate to form the backboard 3, which has an outline substantially similar to the outline of a conventional backboard and which has a hollow interior or cavity 22.

In the preferred embodiment, the frame 7 further includes a platform 17 located above the bottom portion 19 of the peripheral wall 15. The platform 17 is connected to the bottom portion 19 of the peripheral wall by a pair of side walls 21 and a back wall 23. The thickness of the side and back walls 21 and 23, respectively, is preferably approximately 1.5 inches. The front surface of the platform 17, the side walls 21, and peripheral bottom wall portion 19 provide a mounting surface 25.

Secured to the top surface 27 of the frame platform 17 is a light fixture 29. Although a light fixture 29 suitable for incandescent lamps may be employed, I prefer a fixture suitable for a fluorescent lamp 31. The fixture is secured to the frame platform by a number of screws 33. Wires 35 from the fixture pass through the back wall 13 of the frame 7 by means of a grommet 37. The wires 35 lead to a source of electrical power, not shown. A switch 39 may be used to turn the fluorescent lamp 31 on and off from a location remote from the illuminated backboard 1.

To provide access to the light fixture 29 and the lamp 31, a door 41 is connected, as by hinges 43, to the frame back wall 13. To retain the door 41 closed in place, the door includes a flexible latch 45. A knob 47 facilitates opening and closing the door.

Further in accordance with the present invention, a number of ribs 49 are placed in the cavity 22 of the backboard 3. The ribs 49 lie in respective planes perpendicular to the front panel 9, and they preferably extend for the full distance between the front panel and the frame back wall 13. The ribs 49 are made from the same translucent material as the front panel 9. The ribs are bonded to either the front panel or the frame back wall but not to both. The ribs are located such that their respective planes intersect in the region of the light fixture 29. Accordingly, the ribs radiate from the vicinity of the light fixture. A particularly effective pattern for the ribs includes a long central rib 49B and three shorter ribs on each side of the central rib. An angular space of approximately 20 degrees between each rib is satisfactory. If desired, the ribs can be of unequal length.

The hoop 5 is conventional. It is joined to the backboard 3 by fasteners 51 passing through a hoop mounting plate 53 and into the frame mounting surface 25.

The illuminated backboard 1 mounts to a pole 54 in the same manner as a conventional backboard. Any of several well known brackets, typically illustrated at reference numeral 55, can be used to mount the illuminated backboard to the pole 54. Alternately, the illuminated backboard can be mounted to a building roof by suitable brackets, not shown but well known in the art.

The illuminated backboard 1 functions as an ordinary basketball backboard when it is used in lighted conditions. However, in the dark and with the lamp 31 turned on, the illuminated backboard presents a highly pleasing visual effect. The entire front panel 9 glows, with the glow being brightest in the area of the hoop 5. The areas of the front panel directly in front of the ribs 49 glow with less intensity than the other areas of the front panel. The result is the appearance of rays radiating from the hoop. With a sufficiently bright lamp, the basketball court in front of the illuminated backboard is also illuminated sufficiently to play a game of basketball.

Figure 5:
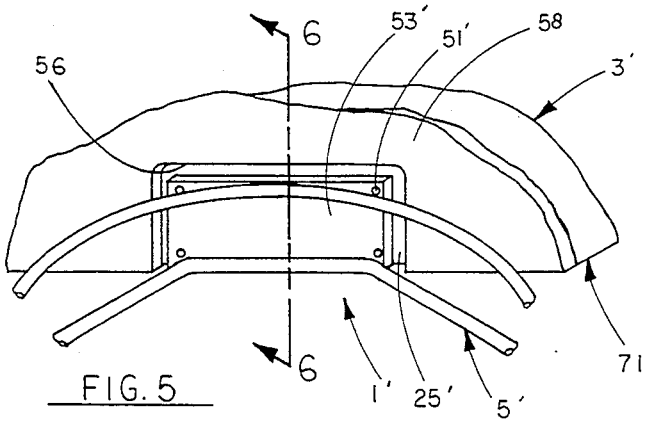
FIG. 5 ms a partial perspective view similar to FIG. 1, but showing an alternate design of the illuminated backboard.
Figure 6:
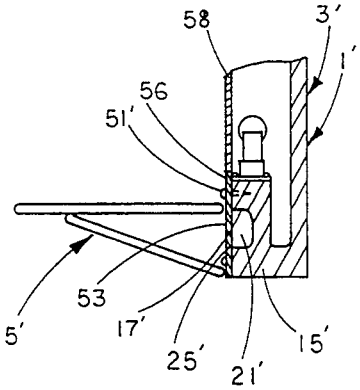
FIG. 6 ms a cross sectional view on an enlarged scale taken along line 6—6 of FIG. 5.

In FIGS. 5 and 6, an alternate illuminated backboard 1' is shown. The illuminated backboard 1' includes a frame 7' and a hoop 5' that may be identical to the frame 7 and hoop 5 described previously in connection with the illuminated backboard 1 of FIGS. 1–4. In the illuminated backboard 1', the mounting plate 53' of the hoop 5' is joined directly to the mounting surface 25' of the frame 7' by screws 51'. To provide clearance for the hoop mounting plate 53', a cutout 56 is made in the front panel 58. Other than the cutout 56, the front panel 58 is identical to the front panel 9 described previously.

Figure 7:
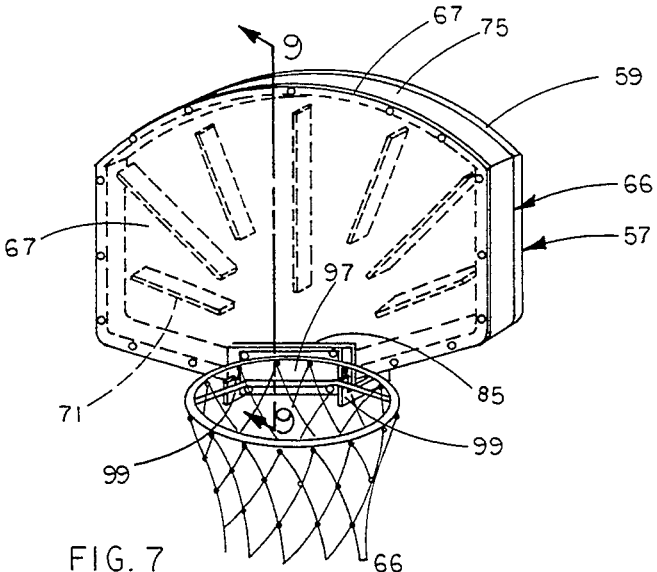
FIG. 7 ms a perspective view of a modified embodiment of the present invention.
Figure 8:
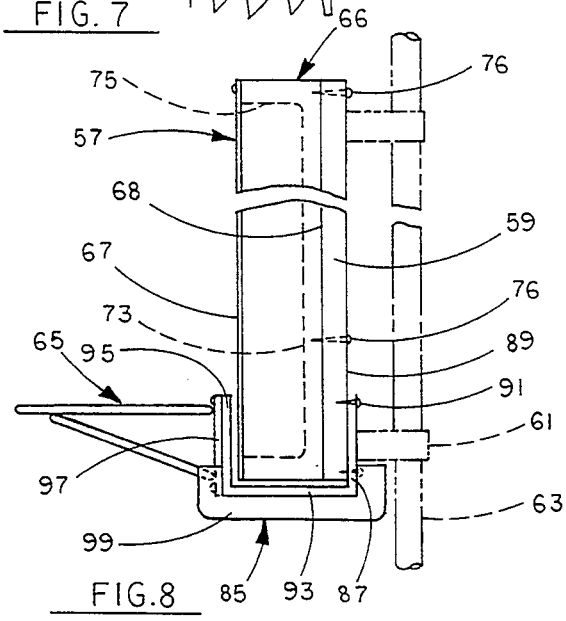
FIG. 8 is a side view on an enlarged scale of FIG. 7.
Figure 9:
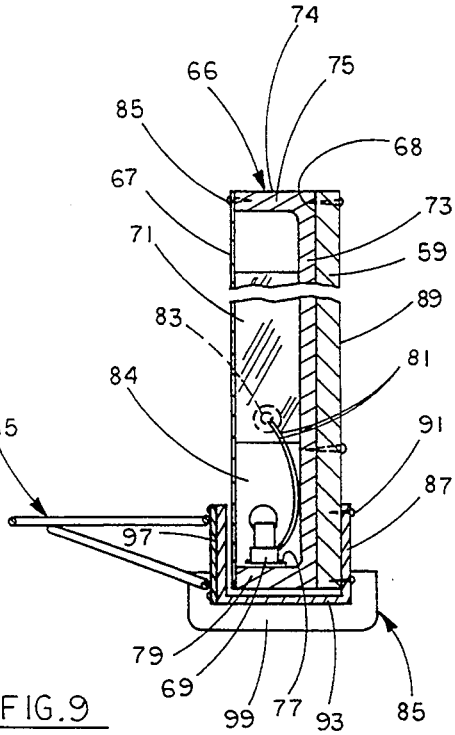
FIG. 9 is a cross sectional view on an enlarged scale taken along line 9—9 of FIG. 7.

Now turning to FIGS. 7–9, an alternate illuminated backboard 57 is shown. The illuminated backboard 57 is designed to be used with a conventional basketball backboard 59. The illuminated backboard 57 is composed of an opaque frame 66, a translucent front panel 67, a light fixture 69, and a number of ribs 71. The frame 66 has a back wall 73 and a peripheral wall 75. The outline 74 of the frame peripheral wall 75 is substantially similar to the outline of the conventional backboard 59. The frame 66 is shown without a platform or walls similar to the platform 17 and walls 21 and 23 of the frame 7 of the illuminated backboard 1 described in conjunction with FIGS. 1–4. However, it will be appreciated that a platform can be incorporated into the frame 66, if desired. The light fixture 69, which may be identical to the fixture 29 used with the illuminated backboard 1 described previously, is secured, as by screws 77, to the bottom portion 79 of the peripheral wall 75. The wires 81 from the light fixture 69 pass through a grommet 83 in a side portion 84 of the peripheral wall.

The translucent front panel 67 is attached to the frame peripheral wall 75 by screws 85 or similar fasteners. Access to the light fixture 69 is by removing the front panel from the frame 66. Alternately, a hinged door, not shown but similar to the door 41 used with the illuminated backboard 1 of FIGS. 1–4, can be incorporated into the side portion 84 of the frame peripheral wall.

In the illustrated construction, the ribs 71 extend between the front panel 67 and the back wall 73 of the frame 66. The ribs are made of the same translucent material as the front panel. The ribs radiate outwardly from the region of the light fixture 69, similar to the ribs 49 of FIGS. 1–4.

The conventional basketball backboard 59 is mounted in known fashion by typical brackets 61 to a pole 63. The hoop 65 of the conventional backboard is removed, and the frame 66 of the illuminated backboard 57 is attached to the front face 68 of the conventional backboard. Attachment of the illuminated backboard frame is by fasteners 76 that enter into the back wall 73 of the frame 66.

It is a feature of the present invention that the illuminated backboard 57 is not subjected to any stresses from the hoop 65. Rather, the hoop is joined to the conventional backboard 59. For that purpose, a U-shaped bracket 85 has a back leg 87 that is secured to the back face 89 of the conventional backboard by screws 91. A middle leg 93 of the bracket 85 passes under the conventional backboard and the illuminated backboard 57. A front leg 95 of the bracket extends vertically in front of the illuminated backboard high enough to enable the mounting plate 97 of the hoop 65 to be fastened to that bracket leg. Preferably, the bracket mounting leg 93 includes one or more stiffening ribs 99.

With the illuminated backboard 57, an existing conventional backboard 59 can be left in place without altering its mounting to a pole 63 or other structure. The hoop 65 is merely removed from the conventional backboard, and the illuminated backboard is attached to the conventional backboard. The bracket 85 is secured to the conventional backboard, the hoop is joined to the bracket, and the illuminated backboard 57 is ready for use. In that manner, the illuminated backboard 57 can be put into use with a minimum of trouble and expense. The operation of the illuminated backboard 57 is substantially similar to the operation of the illuminated backboard 1 described previously.

Thus, it is apparent that there has been provided, in accordance with the invention, an illuminated backboard that fully satisfies the aims and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. An illuminated backboard comprising:

a. an opaque frame having a flat back wall and a peripheral wall upstanding from the back wall, the peripheral wall having a predetermined outline, a front surface, and a bottom portion;

b. a translucent front panel attached to the front surface of the frame peripheral wall and having an outline substantially similar to the outline of the frame peripheral wall, the front panel cooperating with the frame to define a cavity;

c. a hoop joined to the frame; and d. light means secured to the frame in the cavity proximate the hoop for illuminating the front panel.

2. The illuminated backboard of claim 1 wherein:

a. the frame is fabricated with a platform that is spaced a predetermined distance from the bottom portion of the peripheral wall and with wall means for joining the platform to the bottom portion of the frame peripheral wall, the platform, wall means, and peripheral wall bottom portion having respective front surfaces that cooperate to form a mounting surface; and b. the hoop is joined to the frame mounting surface.

3. The illuminated backboard of claim 2 wherein the light means is secured to the frame platform.

4. The illuminated backboard of claim 1 further comprising at least one rib made of translucent material within the cavity and lying in a plane that extends between the front panel and the frame back wall.

5. The illuminated backboard of claim 4 wherein:

a. there are a plurality of ribs; and b. the ribs lie in respective planes that intersect in the region of the light means.

6. The illuminated backboard of claim 5 wherein the ribs have unequal lengths.

7. The illuminated backboard of claim 2 wherein the front panel is interposed between the hoop and the frame mounting surface.

8. Apparatus for playing a basketball game comprising:

a. a translucent planar front panel having the outline of a basketball backboard;

b. a frame attached to the front panel and cooperating therewith to define a cavity, the frame having an outline of a basketball backboard;

c. a hoop joined to the frame; and d. light means in the cavity for illuminating the front panel.

9. The apparatus of claim 8 wherein:

a. the frame comprises:

i. a peripheral wall having a front surface that attaches to the front panel; and ii. platform means for cooperating with the peripheral wall front surface to define a mounting surface; and b. the hoop is joined to the frame mounting surface.

10. The apparatus of claim 9 wherein the light means is secured to the platform means.

11. The apparatus of claim 8 further comprising a plurality of translucent planar ribs located in the cavity and extending generally perpendicular to the plane of the front panel.

12. The apparatus of claim 11 wherein the ribs lie in respective planes that intersect in the region of the light means.

13. The apparatus of claim 9 wherein the front panel is interposed between the hoop and the frame mounting surface.

14. In combination with a basketball backboard, an illuminated backboard comprising:

a. a frame having a peripheral surface with an outline that is substantially identical to the outline of the basketball backboard, the frame being attached to the basketball backboard;

b. a translucent planar front panel attached to the frame and cooperating therewith to define a cavity;

c. light means inside the cavity for selectively illuminating the front panel;

d. a basketball hoop; and e. bracket means secured to the basketball backboard for supporting a hoop at a predetermined location relative to the illuminated backboard, so that the illuminated backboard is not subjected to any stresses from the hoop.

15. The combination of claim 14 further comprising a plurality of translucent ribs located in the cavity and lying in respective planes that extend generally perpendicular to the plane of the front panel.

16. The combination of claim 15 wherein the planes of the ribs intersect in the region of the light means.

17. The combination of claim 16 wherein the light means is located in the cavity proximate the hoop.

18. A method of illuminating a basketball backboard comprising the steps of:

a. providing a conventional basketball backboard with a hoop;

b. removing the hoop from the conventional basketball backboard;

c. attaching a frame to the conventional basketball backboard;

d. attaching a translucent front panel to the frame and forming a cavity by the cooperation of the front panel with the frame;

e. securing a bracket to the conventional basketball backboard;

f. joining the hoop to the bracket proximate the front panel; and g. energizing a source of illumination in the cavity and illuminating the front panel.

19. The method of claim 18 comprising the further steps of:

a. providing a plurality of planar translucent ribs; and b. locating the ribs within the cavity with their respective planes intersecting.

20. The method of claim 19 comprising the further step of locating the ribs within the cavity with their respective ribs intersecting in the region of the hoop.

* * * * *